US009196229B1

(12) United States Patent
Burton

(10) Patent No.: US 9,196,229 B1
(45) Date of Patent: Nov. 24, 2015

(54) PIANO DESK COVER

(71) Applicant: Michael A. Burton, Macomb Township, MI (US)

(72) Inventor: Michael A. Burton, Macomb Township, MI (US)

( * ) Notice: Subject to any disclaimer, the term of this patent is extended or adjusted under 35 U.S.C. 154(b) by 0 days.

(21) Appl. No.: 14/487,738

(22) Filed: Sep. 16, 2014

(51) Int. Cl.

| | |
|---|---|
| ***G10C 3/02*** | (2006.01) |
| ***A47B 19/00*** | (2006.01) |
| ***E06C 7/14*** | (2006.01) |
| ***G10G 7/00*** | (2006.01) |
| ***A47B 23/04*** | (2006.01) |

(52) U.S. Cl.
CPC . *G10C 3/02* (2013.01); *A47B 19/00* (2013.01); *A47B 19/002* (2013.01); *A47B 23/042* (2013.01); *E06C 7/14* (2013.01); *G10G 7/00* (2013.01)

(58) Field of Classification Search
CPC .... A47B 19/00; A47B 19/002; A47B 23/042; G10C 3/02; G10G 7/00
USPC ..... 84/180, 453
See application file for complete search history.

(56) References Cited

U.S. PATENT DOCUMENTS

| | | | | | |
|---|---|---|---|---|---|
| 1,682,767 | A | * | 9/1928 | Opelt | 84/180 |
| 1,960,126 | A | * | 5/1934 | Sharp | 84/183 |
| 3,809,352 | A | * | 5/1974 | Mathias | 248/444.1 |
| D241,393 | S | * | 9/1976 | St. Regis | D6/300 |
| D248,334 | S | * | 6/1978 | Stello | D17/8 |
| 4,773,535 | A | * | 9/1988 | Cook | 206/373 |
| 4,901,899 | A | * | 2/1990 | Barrett | 224/223 |
| D340,150 | S | * | 10/1993 | Tanaka | D6/513 |
| 5,356,109 | A | * | 10/1994 | Biasini | 248/448 |
| 5,413,305 | A | * | 5/1995 | Leeb | 248/460 |
| 5,653,333 | A | * | 8/1997 | Webster | 206/45.2 |
| 5,749,437 | A | * | 5/1998 | Weller | 182/129 |
| D434,901 | S | * | 12/2000 | Eskandry | D3/284 |
| 6,172,293 | B1 | * | 1/2001 | Anderson | 84/453 |
| 6,270,049 | B1 | * | 8/2001 | Olvey | 248/441.1 |
| 6,305,498 | B1 | * | 10/2001 | Itzkovitch | 182/129 |
| D461,977 | S | * | 8/2002 | Mitchell | D6/702 |
| 6,450,337 | B1 | * | 9/2002 | Campagna et al. | 206/373 |
| 6,491,277 | B1 | * | 12/2002 | Chappell et al. | 248/459 |
| 6,563,036 | B1 | * | 5/2003 | Biasini | 84/453 |
| 6,889,950 | B2 | * | 5/2005 | Evanoff | 248/441.1 |
| 7,055,652 | B1 | * | 6/2006 | Williams | 182/129 |
| 7,576,272 | B2 | * | 8/2009 | Houfek | 84/180 |
| 8,198,523 | B1 | * | 6/2012 | Price | 84/453 |
| 2005/0012014 | A1 | * | 1/2005 | Willner et al. | 248/441.1 |
| 2008/0190721 | A1 | * | 8/2008 | Burton | 190/103 |

* cited by examiner

*Primary Examiner* — David Warren
*Assistant Examiner* — Christina Schreiber
(74) *Attorney, Agent, or Firm* — Kyle A. Fletcher, Esq.

(57) ABSTRACT

The piano desk cover that is configured to be placed over a piano desk in order to protect the finish of the piano desk from scratches or marring. The piano desk cover includes end flaps on distal ends that are configured to engage ends of the piano desk. Each end flap includes an end flap strap that is configured to extend underneath the piano desk, and secure to an inner surface of the end flap so as to secure the respective end of the piano desk cover to the piano desk. The piano desk cover also includes a tensioning flap that extends down a middle of the piano desk cover. The tensioning flap includes a tensioning strap so as to secure the middle portion of the piano desk cover to the piano desk.

15 Claims, 5 Drawing Sheets

PIANO DESK COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of accessories for a piano, more specifically, a desk cover that is configured for use with a piano desk in order to protect said piano desk from scratchers and/or damage.

SUMMARY OF THE INVENTION

An embodiment of the disclosure meets the needs presented above by generally comprising a piano desk cover that is configured to be placed over a piano desk in order to protect the finish of the piano desk from scratches or marring. The piano desk cover includes end flaps on distal ends that are configured to engage ends of the piano desk. Each end flap includes an end flap strap that is configured to extend underneath the piano desk, and secure to an inner surface of the end flap so as to secure the respective end of the piano desk tensioning flap that extends down a middle of the piano desk cover. The tensioning flap includes a tensioning strap so as to secure the middle portion of the piano desk cover to the piano desk.

These together with additional objects, features and advantages of the piano desk cover will be readily apparent to those of ordinary skill in the art upon reading the following detailed description of presently preferred, but nonetheless illustrative, embodiments of the piano desk cover when taken in conjunction with the accompanying drawings.

In this respect, before explaining the current embodiments of the piano desk cover in detail, it is to be understood that the piano desk cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the piano desk cover.

It is therefore important that the claims be regarded as including such equivalent construction insofar as they do not depart from the spirit and scope of the piano desk cover. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
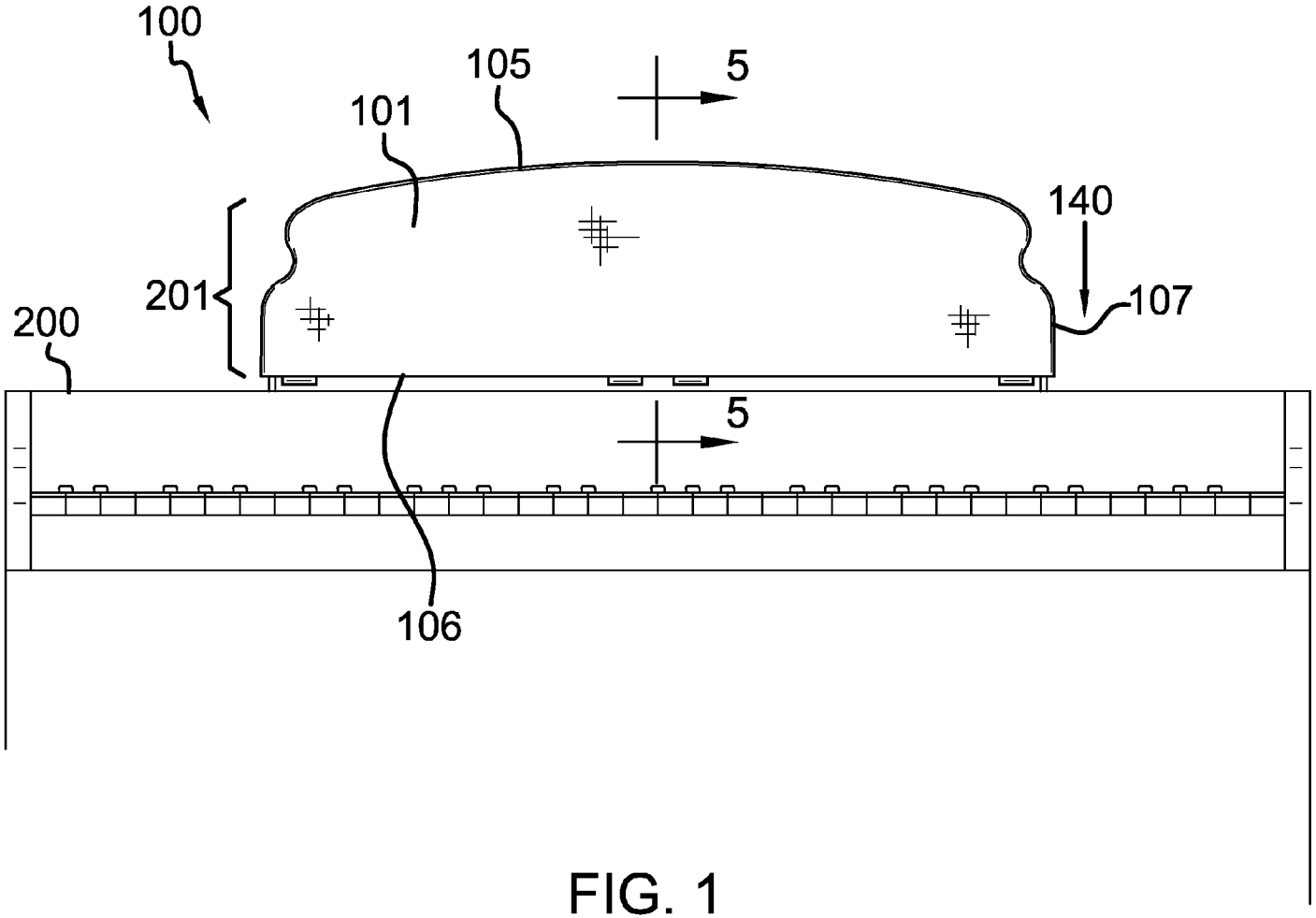
FIG. 1 is a front view of the piano desk cover secured onto a piano desk.
Figure 2:
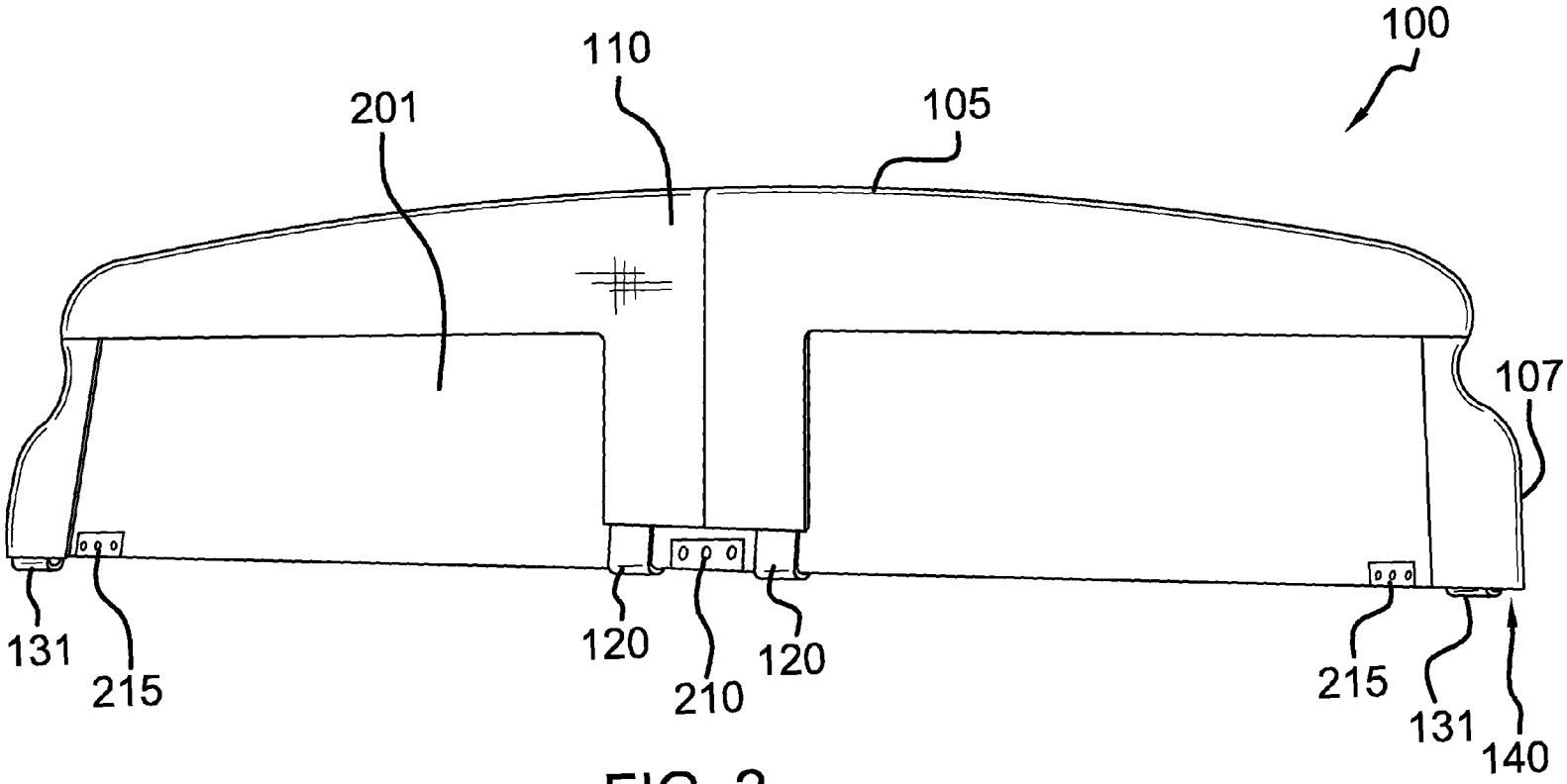
FIG. 2 is a rear, perspective view of the piano desk cover installed onto a piano desk.
Figure 3:
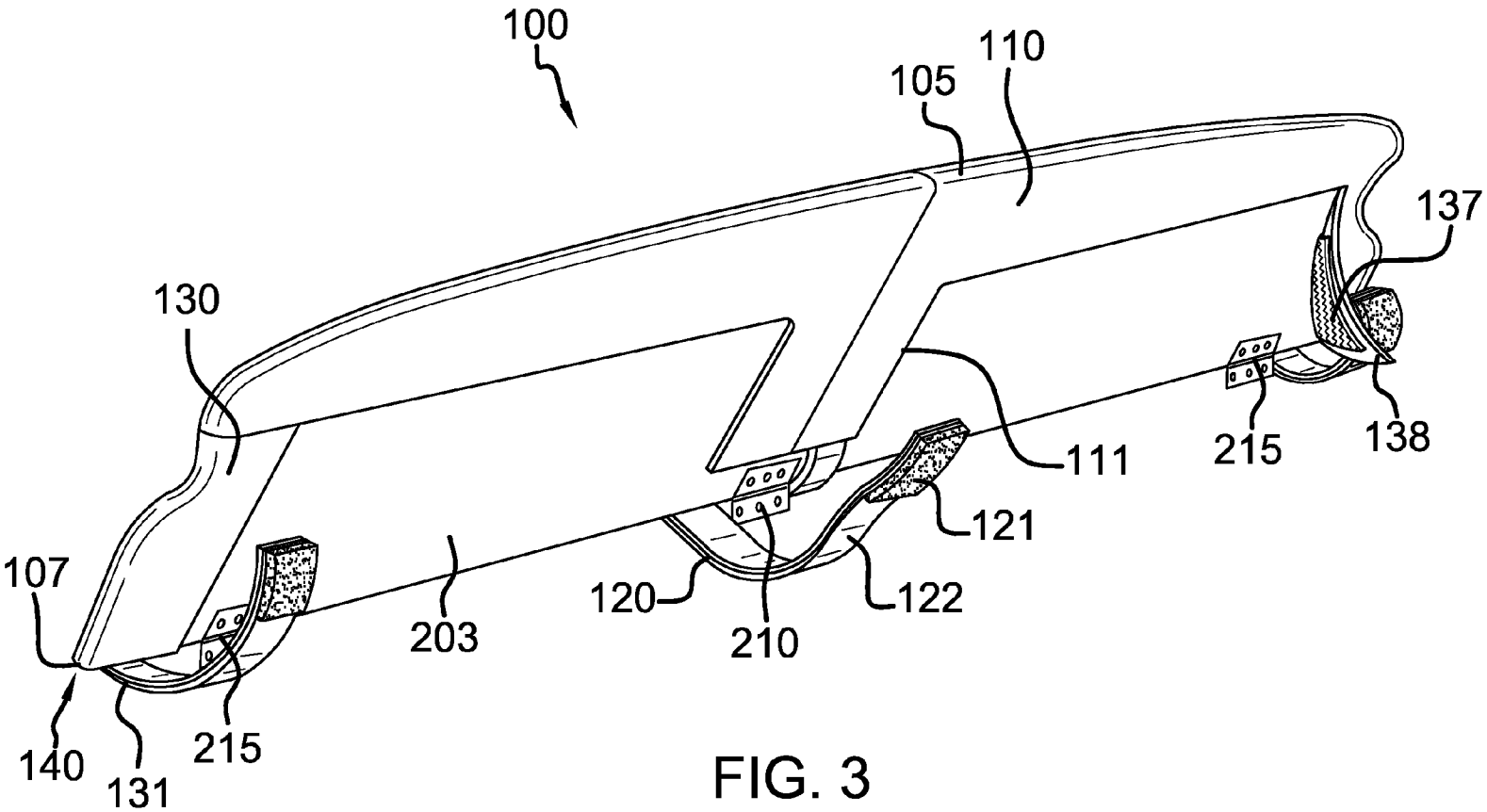
FIG. 3 is another rear, perspective view of the end flap straps and the tensioning strap unsecured to the piano desk cover.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 5, the piano desk cover 100 (hereinafter invention) generally comprises a forward member 101 that is configured to be placed against a forward surface 202 of a piano desk 201. The forward member 101 may be made of a soft leather or other material suitable for protecting the finish of the forward surface 202 of the piano desk 201 of a piano 200. It shall be noted that the piano desk 201 is usually positioned on top of the piano 200.

A rear member 110 is affixed to the forward member 101 along a top edge 105. The rear member 110 is configured to partially cover and engage against a rear surface 203 of the piano desk 201. The invention 100 as a whole is designed to be configured to be placed onto the piano desk like a fitted article, and which is placed onto the piano desk 201 from above. The rear member 110 is a "T-shaped" object that includes a tensioning flap 111 that extends downwardly from the top, edge 105.

The forward member 101 is further defined with a bottom edge 106. The bottom edge 106 includes at least one tensioning strap 120 that is configured to pass underneath the piano desk 201, and attach to the tensioning flap 111 positioned along the rear surface 203 of the piano desk 201. It shall be noted that the figures depict a pair of tensioning straps 120 that straddle opposing sides of a central piano desk hinge 210. Moreover, the tensioning straps 120 include a central nylon hook or loop strip 121 along an outer surface 122. The central nylon hook or loop strip 121 is able to attach to a corresponding tensioning flap nylon hook or loop strip 115. The tensioning flap nylon hook or loop strip 115 is located on an inner tensioning surface 116 of the tensioning flap 110.

The invention 100 also includes end flaps 130 that attach to distal edges 107 located on the forward member 101. The end flaps 130 are configured to extend around each end of the piano desk 201. The forward member 101 includes two end flap strap 131 that extend down from the bottom edge 106 in order to attach to the corresponding end flap 130. It shall be noted that the end flap straps 131 may be positioned between a distal end 140 and a distal end piano desk hinge 215 in order to further secure the invention 100 to the piano desk 201.

Figure 4:
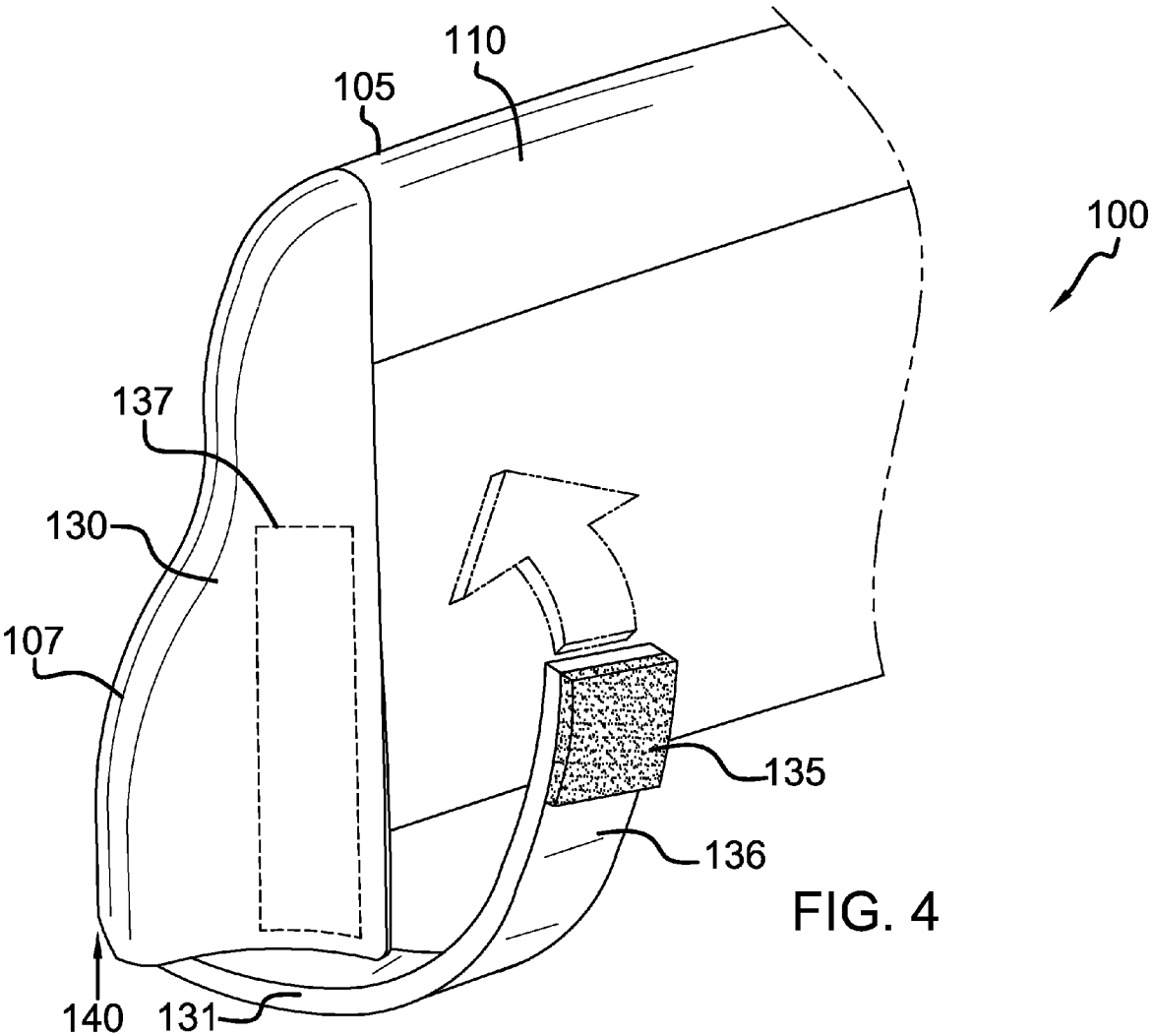
FIG. 4 is a detail view of one of the end flap straps.

Referencing FIG. 4, the end flap straps 131 each include a distal end nylon hook or loop strip 135 on an outer end flap strap surface 136. The distal end nylon hook or loop strip 135 is able to attach to an end flap nylon hook or loop strip 137 provided on an inner surface 138 of the end flap 130.

Figure 5:
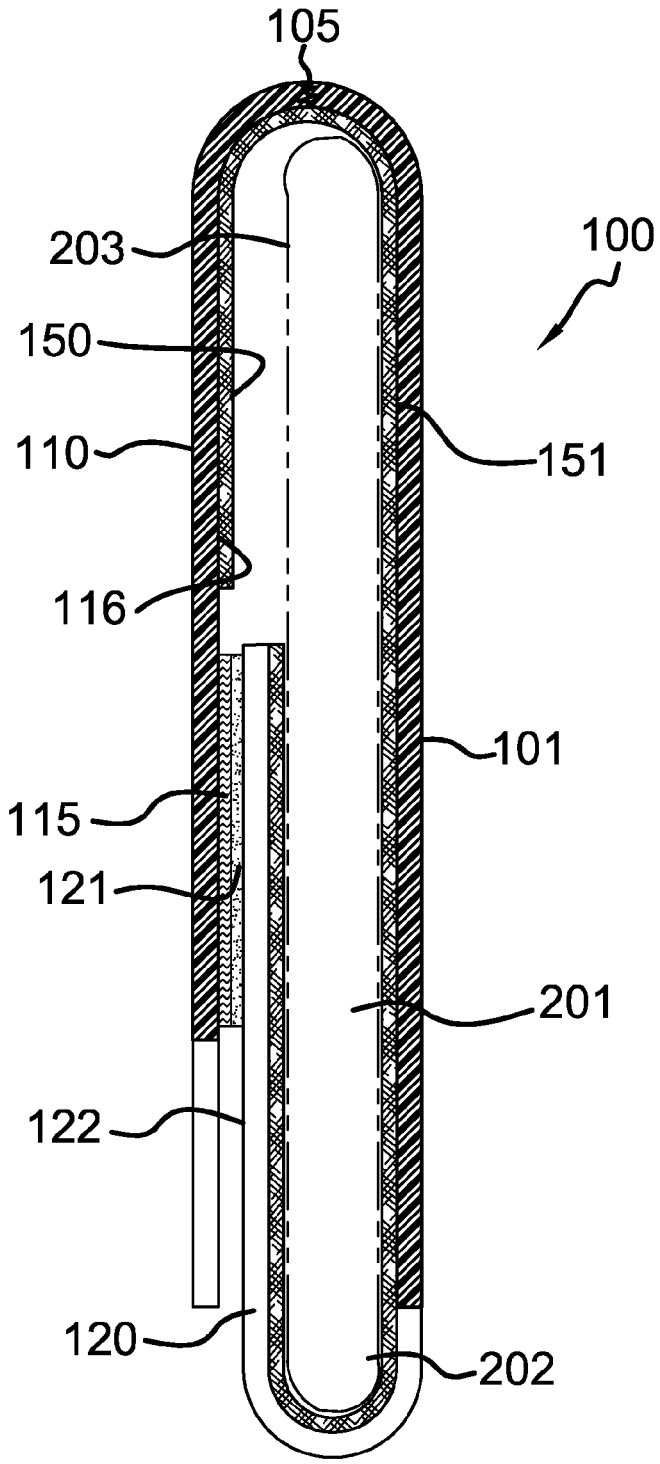
FIG. 5 is a cross-sectional view along line 5-5 in FIG. 1.

Referring to FIG. 5, an inner padded layer 150 may be affixed to the inner tension surface 116 of the tensioning flap 110 as well as to an inner surface 151 of the forward member 101. The inner padded layer 150 may be made of a soft cloth or foam material, and actually interfaces with the forward surface 202 as well as the rear surface 203 of the piano desk 201.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A piano desk cover comprising:

a forward member that is configured to be positioned onto a piano desk in order to protect a finish of said piano desk from damage when in use;

a rear member is affixed to the forward member along a top edge such that the forward member is configured to abut against a forward surface of the piano desk and the rear member is configured to abut against a rear surface of the piano desk; wherein the forward member is further defined with a bottom edge; wherein the bottom edge includes at least one tensioning strap that is configured to pass underneath the piano desk; wherein end flaps attach to distal edges located on the forward member;

wherein the end flaps are configured to extend around each distal end of the piano desk.

2. The piano desk cover according to claim 1 wherein the rear member is configured to partially cover and engage against the rear surface of the piano desk.

3. The piano desk cover according to claim 2 wherein the rear member is a "T-shaped" object that includes a tensioning flap that extends downwardly from the top, edge.

4. The piano desk cover according to claim 3 wherein the at least one tensioning strap is configured to attach to the tensioning flap positioned along the rear surface of the piano desk.

5. The piano desk cover according to claim 4 wherein the at least one tensioning straps is adjacent to a central piano desk hinge.

6. The piano desk cover according to claim 5 wherein the tensioning straps include a central nylon hook or loop strip along an outer surface.

7. The piano desk cover according to claim 6 wherein the central nylon hook or loop strip is able to attach to a corresponding tensioning flap nylon hook or loop strip.

8. The piano desk cover according to claim 7 wherein the tensioning flap nylon hook or loop strip is located on an inner tensioning surface of the tensioning flap.

9. The piano desk cover according to claim 8 wherein the forward member includes two end flap strap that extend down from the bottom edge in order to attach to the corresponding end flap.

10. The piano desk cover according to claim 9 wherein the end flap straps are each positioned between a distal end and a distal end piano desk hinge in order to further secure the piano desk cover to the piano desk.

11. The piano desk cover according to claim 10 wherein the end flap straps each include a distal end nylon hook or loop strip on an outer end flap strap surface.

12. The piano desk cover according to claim 11 wherein the distal end nylon hook or loop strip is able to attach to an end flap nylon hook or loop strip provided on an inner surface of the end flap.

13. The piano desk cover according to claim 12 wherein an inner padded layer is affixed to the inner tension surface of the tensioning flap as well as to an inner surface of the forward member; wherein the inner padded layer interfaces with the forward surface as well as the rear surface of the piano desk.

14. A piano desk cover comprising:

a forward member that is configured to be positioned onto a piano desk in order to protect a finish of said piano desk from damage when in use;

a rear member is affixed to the forward member along a top edge such that the forward member is configured to abut against a forward surface of the piano desk and the rear member is configured to abut against a rear surface of the piano desk;

wherein the rear member is configured to partially cover and engage against the rear surface of the piano desk;

wherein the rear member is a "T-shaped" object that includes a tensioning flap that extends downwardly from the top, edge;

wherein the forward member is further defined with a bottom edge; wherein the bottom edge includes at least one tensioning strap that is configured to pass underneath the piano desk, and attach to the tensioning flap positioned along the rear surface of the piano desk;

wherein the at least one tensioning straps is adjacent to a central piano desk hinge;

wherein the tensioning straps include a central nylon hook or loop strip along an outer surface; wherein the central nylon hook or loop strip is able to attach to a corresponding tensioning flap nylon hook or loop strip;

wherein the tensioning flap nylon hook or loop strip is located on an inner tensioning surface of the tensioning flap; wherein end flaps attach to distal edges located on the forward member;

wherein the end flaps are configured to extend around each distal end of the piano desk; wherein the forward member includes two end flap strap that extend down from the bottom edge in order to attach to the corresponding end flap; wherein the end flap straps are each positioned between a distal end and a distal end piano desk hinge in order to further secure the piano desk cover to the piano desk.

15. The piano desk cover according to claim 14 wherein the end flap straps each include a distal end nylon hook or loop strip on an outer end flap strap surface; wherein the distal end nylon hook or loop strip is able to attach to an end flap nylon hook or loop strip provided on an inner surface of the end flap; wherein an inner padded layer is affixed to the inner tension surface of the tensioning flap as well as to an inner surface of the forward member; wherein the inner padded layer interfaces with the forward surface as well as the rear surface of the piano desk.

* * * * *